United States Patent [19]

Leveraus

[11] 3,948,039

[45] Apr. 6, 1976

[54] HOUR METER OPERATED RESPONSIVE TO TACHOMETER SIGNAL

[75] Inventor: James E. Leveraus, Milwaukee, Wis.

[73] Assignee: Allis-Chalmers Corporation, Milwaukee, Wis.

[22] Filed: Dec. 24, 1974

[21] Appl. No.: 536,088

[52] U.S. Cl. ..... 58/146; 58/39.5

[51] Int. Cl.[2] ..... G07C 3/02; G04F 8/00

[58] Field of Search ..... 58/146, 39.5

[56] References Cited

UNITED STATES PATENTS

| | | | |
|---|---|---|---|
| 1,340,324 | 5/1920 | Buck | 58/146 |
| 3,379,056 | 4/1968 | Ellison | 58/146 X |
| 3,636,703 | 1/1972 | Dileski | 58/146 |

*Primary Examiner*—George H. Miller, Jr.
*Attorney, Agent, or Firm*—Arthur L. Nelson

[57] ABSTRACT

An hour meter on a tractor for registering the operating time of the tractor connected for receiving a tachometer signal to energize the hour meter circuit and thereby register the time of engine operation of the vehicle responsive to actual operating time of the engine.

10 Claims, 2 Drawing Figures

HOUR METER OPERATED RESPONSIVE TO TACHOMETER SIGNAL

Figures 1, 2:
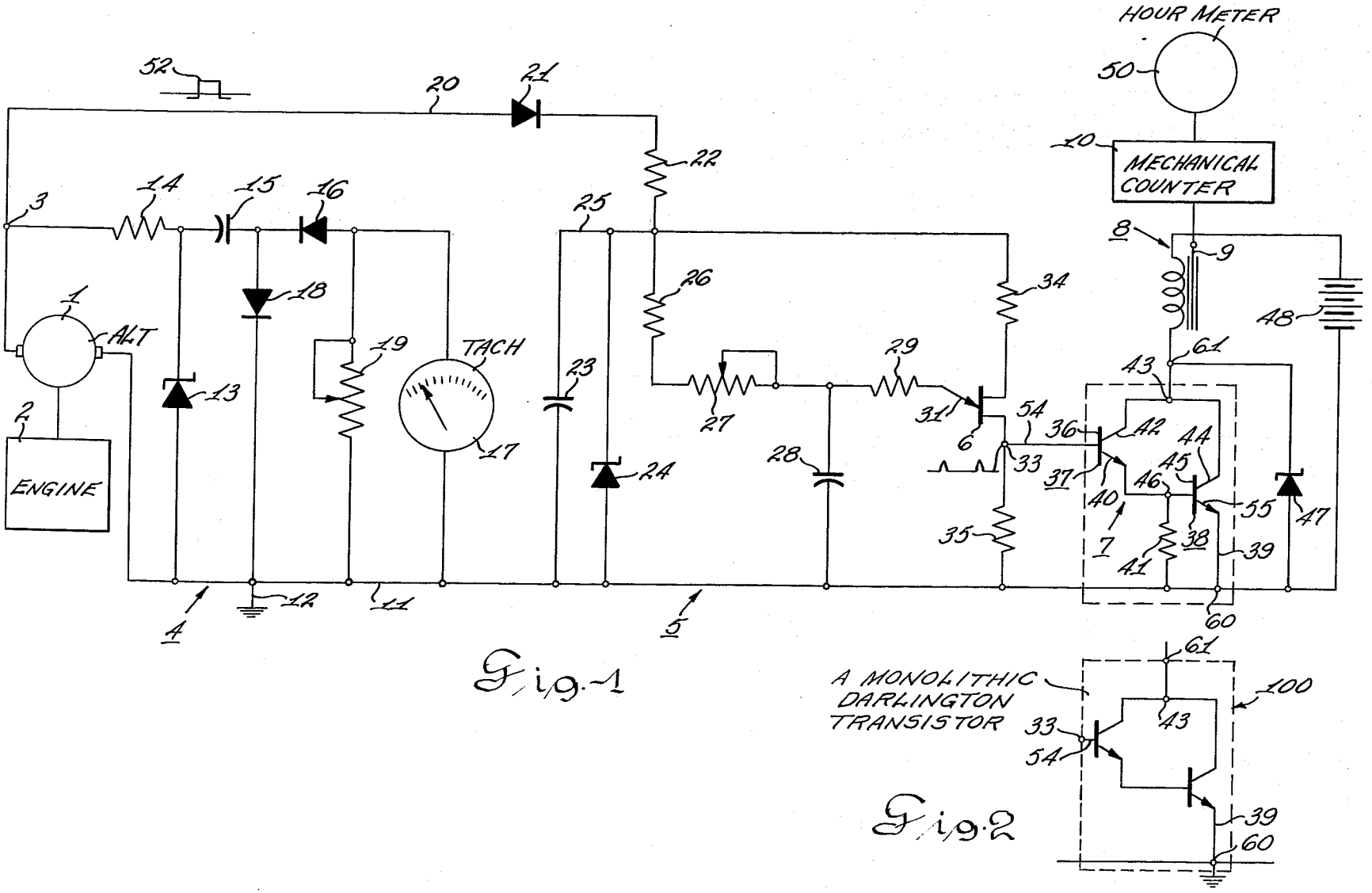

This invention relates to an hour meter and, more particularly, to an hour meter connected to operate responsive to a tachometer signal to register the actual time of engine operation.

Hour meters are provided on many vehicles to register the actual running time of the vehicle. The conventional connection for the hour meter is through a switch which may be the ignition switch or any switch which is required to be turned on for the operation of the vehicle. While this may seem to be an accurate means of recording the actual running time of the vehicle, it does not always prove to be as accurate as it may seem. The ignition switch may be turned on accidentally and may remain on for a matter of hours. This can happen during shipment of the tractor and a considerable lapse of time may have transpired before it is noticed that the switch is on. Accordingly, under these circumstances, it is almost impossible to know the actual running time of the vehicle since the actual time recorded on the hour meter is in error. It is difficult to disprove the amount of time recorded on the vehicle and yet this would indicate the vehicle has had substantial use. On a new vehicle, this may present a problem.

Accordingly, this invention is intended to overcome such a problem and to actually record the time of operation of the vehicle. The hour meter is used to record engine running time, and the electrical connections for operating the hour meter are connected in a manner whereby it is believed the circuit is foolproof. The circuit for operating the recording of the time in the hour meter is energized by a switch connected battery and the timing circuit is operated by a signal which normally operates the tachometer. This signal is generated by the alternator which normally operates the tachometer and which is also applied to the timing circuit on the hour meter to provide an accurate recording of the hours which the engine has actually been running.

Accordingly, it is an object of this invention to provide an hour meter circuit for operating the hour meter on a vehicle responsive to energization from a signal for operating the tachometer.

It is another object of this invention to provide an hour meter on a vehicle energized by a battery and with a timing portion receiving energization for a signal for operating the tachometer.

It is a further object of this invention to provide an hour meter on a vehicle connected through a switch to energize the hour meter circuit with the timing control for circuit energized from the tachometer signal generated by the alternator on a vehicle.

The objects of this invention are accomplished by providing a battery energized hour meter circuit with battery connection through a switch which is normally closed when the engine is in operation. The timing circuit for initiating operation of the hour meter circuit receives a signal which is normally applied to the tachometer. The signal is applied to an oscillator circuit which produces a pulse signal at predetermined time intervals. The pulse signal is applied to an electronic switch circuit. The electronic switch circuit and a solenoid circuit are energized by a battery. The electronic switch intermittently triggers pulses of current flow through the solenoid to operate a mechanical counter and the hour meter. Accordingly, the hour meter is operated when the switch is closed and when a signal is received from the alternator to provide a recording of the time that the engine is in operation.

The preferred embodiments of the invention are illustrated in the attached drawings:

FIG. 1 illustrates the preferred embodiments of this invention showing the tachometer circuit for receiving a signal from an alternator and the hour meter circuit which is battery energized connected to the hour meter for registering vehicle running time; and FIG. 2 is a modification of the electronic switch used in FIG. 1.

Referring to the drawings, FIG. 1 shows an alternator 1 which is normally operated by the vehicle engine 2. The alternator supplies a signal to the terminal 3 at the input of the tachometer circuit 4. A pulse signal from the alternator is also supplied to the timing circuit 5. The timing circuit includes an oscillator circuit which generates a pulse signal of predetermined timed interval and pulse width which is then applied to the unijunction transistor 6 for triggering the electronic switching circuit 7. The electronic switching circuit is connected with the solenoid 8 across battery 48. The solenoid 8 operates the armature 9 which is connected to a mechanical counter 10 and the hour meter 50.

The conductor 11 is connected to ground 12. The terminal 3 is connected to the alternator 1 and supplies the signal at the terminal 3 for operating the tachometer circuit 4 and the hour meter circuit. The tachometer circuit includes the zener diode 13 connected between the resistor 14 and the capacitor 15 and connected to ground. The capacitor 15 is connected to the diode 16. The diode 16 is also connected to the tachometer 17 which in turn is connected to ground. The diode 18 is connected between the capacitor 15 and the diode 16 and to ground. A variable resistance 19 is connected between the diode 16 and the tachometer and to ground. This circuit normally operates to receive an alternating signal from the alternator at a frequency depending upon the speed of rotation of the alternator. The signals are applied to the tachometer circuit. The magnitude of the pulses applied to the tachometer are clipped by the tachometer circuit. The tachometer reading, accordingly, increases in proportion to the frequency of the alternator signal.

Simultaneously, a signal is applied through a conductor 20 through the diode 21 and resistor 22 to the hour meter circuit 5. The signal applied to the terminal 3 and transmitted through the conductor 20 is an alternating signal producing a positive pulse at a frequency responsive to the speed of rotation of the alternator. The signal is rectified by a rectifier circuit which operates essentially as a power supply for the hour meter circuit 11. The rectifier circuit consists essentially of the diode 21, the resistor 22, the capacitor 23 and the zener diode 24. The zener diode is a 12-volt diode connected between the conductor 25 and ground in parallel with the condenser 23. The resistor 22 is connected to the zener diode 21 transmitting the input signal to the conductor 25. The conductor 25 is maintained essentially at 11 volts d.c. to operate as the positive potential of a power supply.

A unijunction oscillator is connected between the conductor 25 and ground and consists essentially of the fixed resistor 26 and the variable resistor 27 which controls the timing of the oscillator circuit. The capacitance 28 is connected in series with the resistors 27 and 26 between the conductor 25 at the 11 volt potential and ground. The emitter 31 of the unijunction transistor 6 is connected to the resistor 29 which is connected to the resistor 27 and to the condenser 28. The base-one of the unijunction transistor 6 is connected to the junction 33. The junction 33, in turn, is connected through the resistor 35 to ground and also connected to the base 36 of the transistor 37. The base-two of transistor 31 is connected through the resistor 34 to the conductor 25 at the 11 volt potential. The resistor 29 controls the discharge time and, accordingly, the pulse width at junction 33 which is applied to the base 36 of the transistor 37.

The switching circuit 7 includes the transistor 37 and transistor 38. The emitter 55 of transistor 38 is connected through conductor 39 to ground. The base of the transistor 38 and the emitter 40 of transistor 37 are connected through the resistor 41 to ground. The collector 42 of transistor 37 is connected to the junction 43 as is the collector 44 of transistor 38. The base 45 of transistor 38 is connected to the junction 46. The zener diode 47 is essentially a safety diode which discharges at 20 volts to protect against reverse polarity of the battery 48 and protect the switching circuit.

The solenoid 8 is triggered by the switching circuit 7 which energizes the solenoid and causes the armature 9 to operate a mechanical counter 10 in the hour meter 50.

The operation of the circuit will be described in the following paragraphs.

The alternator 1 is driven by the engine 2 and generates a signal responsive to engine speed. The alternator 1 generates an alternating signal which is applied to the terminal 3. The alternating signal applied to the terminal 3 is indicated at 52. This signal has a frequency responsive to the rotation of the alternator. The signal applied to the tachometer circuit produces pulses which are applied to the tachometer and tachometer reading increases responsive to the frequency of the pulses supplied to the tachometer. The pulses are limited to a predetermined positive value in the circuit so that the frequency of the pulses determines the magnitude of the reading on the tachometer.

These signals are also applied to the conductor 20 which operate as a rectifier circuit in combination with the diode 21, the resistor 22, the capacitor 23 and the zener diode 24. The break down voltage of the zener diode is 11 volts and accordingly the voltage on the conductor 25 is maintained at essentially a level of 11 volts d.c. The 11 volts on the conductor 25 operate as a power supply for the unijunction oscillator circuit. The condenser 28 charges through the resistors 27 and 26 which control the timing of the charging of the condenser 28. The emitter 31 of the unijunction transistor 6 is initially reverse-biased, and hence, nonconducting. As a capacitor 28 is charged through the resistors 27 and 26, the emitter voltage rises exponentially toward the supply voltage of the conductor 25. When the emitter voltage reaches the peak value, the emitter becomes forward biased and the dynamic resistance between the emitter and the base-one drops to a low value. The capacitor 28 is then discharged through the emitter and resistor 35. When the emitter voltage reaches a minimum voltage, the emitter ceases to conduct and the cycle is repeated. The resistor 29 controls the discharge time of the condenser 28 through the resistor 35.

The pulse signal at the terminal 33 is essentially a pulse signal with pulses at predetermined time intervals. The pulse signal is applied to the base 36 of the transistor 37 which triggers conduction through the resistor 41 and emitter 40 and the collector 42 through the solenoid 8. Conduction through the resistor 41 also applies a bias to the base 45 of the transistor 38 causing conduction through the transistor 38 through the emitter 55 and collector 44 of the transistor 38. The current flows through the solenoid 8 as the switching circuit is conducting. The maximum voltage across the switching circuit is controlled by the zener diode 47.

When the solenoid 8 is conducting the armature 9 reciprocates to a second position. The solenoid operates the mechanical counter 10 in the hour meter 50. Energization for the solenoid and the switching circuit is provided by the battery 48.

FIG. 2 illustrates a modified switching circuit wherein a resistor 41 is eliminated. The terminal 33 is connected through the conductor 54 to the base of the transistor 37.

FIG. 2 illustrates a modification of the switching circuit, where a monolithic device 100 replaces the transistors 37, 38 and resistor 41 as shown in FIG. 1 between the terminal 33 and the terminal 60, as well as a terminal 61. The terminal 61 is connected to the solenoid 8 and also to the zener diode 47.

The embodiments of the invention in which an exclusive property or privilege is claimed are defined as follows:

1. An hour meter circuit for operating an hour meter on a vehicle comprising, an oscillator circuit, a rectifying circuit connected to said oscillator circuit for energizing said oscillator circuit, an engine driven signal generator generating an electrical signal applied to said rectifier circuit, an electronic switching circuit triggered by said oscillator circuit, an hour meter, a solenoid intermittently energized by said electronic switching circuit, a solenoid operated counter, an hour meter connected to said counter, a source of electrical energy supplying electrical energy to said solenoid and said electronic switching circuit thereby providing an hour meter operating only when said engine driven signal generator is operating.

2. An hour meter circuit for operating an hour meter on a vehicle as set forth in claim 1 wherein said signal generator defines an alternator.

3. An hour meter circuit for operating an hour meter on a vehicle as set forth in claim 1 including a circuit for operating a tachometer, means applying said electrical signal to said tachometer circuit and said rectifier circuit.

4. An hour meter circuit for operating an hour meter on a vehicle as set forth in claim 1 wherein said source of electrical energy for operating said solenoid and switching circuit defines a battery and an electrical switch.

5. An hour meter circuit for operating an hour meter on a vehicle as set forth in claim 1 including a safety zener diode connected across said switching circuit for providing a safety circuit for said switching circuit.

6. An hour meter circuit for operating an hour meter on a vehicle as set forth in claim 1 including a tachometer circuit for energizing a tachometer, a terminal connected to the input of said tachometer circuit and connected to the input of said rectifier circuit.

7. An hour meter circuit for operating as an hour meter on a vehicle as set forth in claim 1 including, a variable resistor for controlling the frequency of oscillation of said oscillator circuit.

8. An hour meter circuit for operating an hour meter on a vehicle as set forth in claim 1 including a resistance capacitance discharge time control for controlling the frequency of oscillation of said oscillator.

9. An hour meter circuit for operating an hour meter on a vehicle as set forth in claim 1 wherein said oscillator circuit includes a unijunction oscillator for controlling the triggering of said switching circuit.

10. An hour meter circuit for operating an hour meter on a vehicle as set forth in claim 1 including a mechanical counter, an armature in said solenoid connected to said mechanical counter for registering engine running time on said hour meter.

* * * * *